US006350161B2

(12) United States Patent
Lacoy

(10) Patent No.: US 6,350,161 B2
(45) Date of Patent: Feb. 26, 2002

(54) CONNECTOR SYSTEMS

(75) Inventor: Donald Richard Lacoy, Bolyston, MA (US)

(73) Assignee: Smith Group PLC, London (GB)

( * ) Notice: Subject to any disclaimer, the term of this patent is extended or adjusted under 35 U.S.C. 154(b) by 0 days.

(21) Appl. No.: 09/780,357

(22) Filed: Feb. 12, 2001

(30) Foreign Application Priority Data

Feb. 12, 2000 (GB) ..... 0003175

(51) Int. Cl.[7] ..... H01R 13/502
(52) U.S. Cl. ..... 439/701
(58) Field of Search ..... 439/701, 687, 439/696, 465, 466, 467

(56) References Cited

U.S. PATENT DOCUMENTS 2,750,572 A * 6/1956 Box ..... 439/185
3,668,604 A * 6/1972 Rossman ..... 439/17 CF
4,596,432 A * 6/1986 Tighe, Jr. ..... 439/107
4,671,601 A * 6/1987 Lomecka ..... 439/404
4,682,838 A * 7/1987 Achtnig et al. ..... 439/598
4,715,827 A * 12/1987 Furman ..... 439/46
5,215,480 A * 6/1993 Lesslie et al. ..... 439/709
5,505,637 A * 4/1996 Kramer et al. ..... 439/610
5,586,916 A * 12/1996 Shinji et al. ..... 439/752
5,632,647 A * 5/1997 Dobbin et al. ..... 439/521
5,995,319 A * 11/1999 Tanigawa et al. ..... 360/99
6,028,865 A * 2/2000 Rusche et al. ..... 370/419
6,183,309 B1 * 2/2001 Chiang ..... 439/687

FOREIGN PATENT DOCUMENTS

GB 2 296 395 A 6/1996

* cited by examiner

*Primary Examiner*—Gary Paumen
*Assistant Examiner*—Phoung Nguyen
(74) *Attorney, Agent, or Firm*—Connolly, Bove, Lodge & Hutz LLP

(57) ABSTRACT

A connector system comprises at least three different connectors each having a common width and a different depth. Each connector is made up of a block and two housing parts. The housing parts are selected from a group of parts of different depths such that the smallest connector can be made from two identical parts of the smallest depth, the largest can be made from two identical parts of the largest depth and intermediate sizes can be made from combinations of parts of different depths.

6 Claims, 4 Drawing Sheets

CONNECTOR SYSTEMS

BACKGROUND OF THE INVENTION

This invention relates to connector systems.

Electrical connectors commonly comprise a connector block supporting a number of electrical contacts, and an outer housing or shell provided in two parts fitted about the connector block. The connector block usually has an orthogonal array of contacts, which may be in a single row or in multiple parallel rows. For each connector block of a different size, a corresponding different housing or shell is needed. Even in a connector system having a common width, a large number of different size shells are needed if the depth varies from connector to connector. The need to make many different size shells adds to the cost of manufacture and makes stocking of spares for the user more difficult.

BRIEF SUMMARY OF THE INVENTION

It is an object of the present invention to provide an alternative connector system.

According to one aspect of the present invention there is provided a connector system comprising n different connectors formed of n connector blocks and 2n housing parts where n is at least three, the connector blocks each having a common width and a depth that differs from block to block, the connector housing parts each having a common width and some have a different depth from one another, each connector including one connector block and two housing parts, and at least one connector having two housing parts of different depths and at least two connectors have two housing parts of identical depth.

n may be nine, the system including eighteen housing parts having four different depths. The depth of the different depth housing parts may increase in steps of h, 3h and 6h over the depth of the smallest part.

According to another aspect of the present invention there is provided a connector system including at least three connectors, each connector having a common width and a different depth, each connector including a two-part housing formed from selected ones of two different parts, and the two different parts having a common width and two different depths, namely a first depth and a second depth larger than the first depth such that a connector of the smallest depth can be formed from two housing parts of the first depth, a connector of an intermediate depth can be formed from one housing part of the first depth and another housing part of the second depth, and a connector of the largest depth can be formed from two housing parts of the second depth.

According to a further aspect of the present invention there is provided a method of forming two connectors of different sizes from n connector blocks and 2n housing parts, where n is at least three, the connector blocks each having a common width and a depth that differs from block to block, the connector housing parts each having a common width and some having a different depth from one another, including the steps of selecting a first connector block and two housing parts, joining the block and housing parts to form a first connector, selecting a second connector block of a different depth from the first block and two housing parts at least one of which has a different depth from the housing parts of the first connector, and joining the block and housing parts to form a second connector having a depth different from that of the first connector.

A connector system according to the present invention will now be described, by way of example, with reference to the accompanying drawings.

DETAILED DESCRIPTION OF THE PREFERRED EMBODIMENTS

Figure 1:
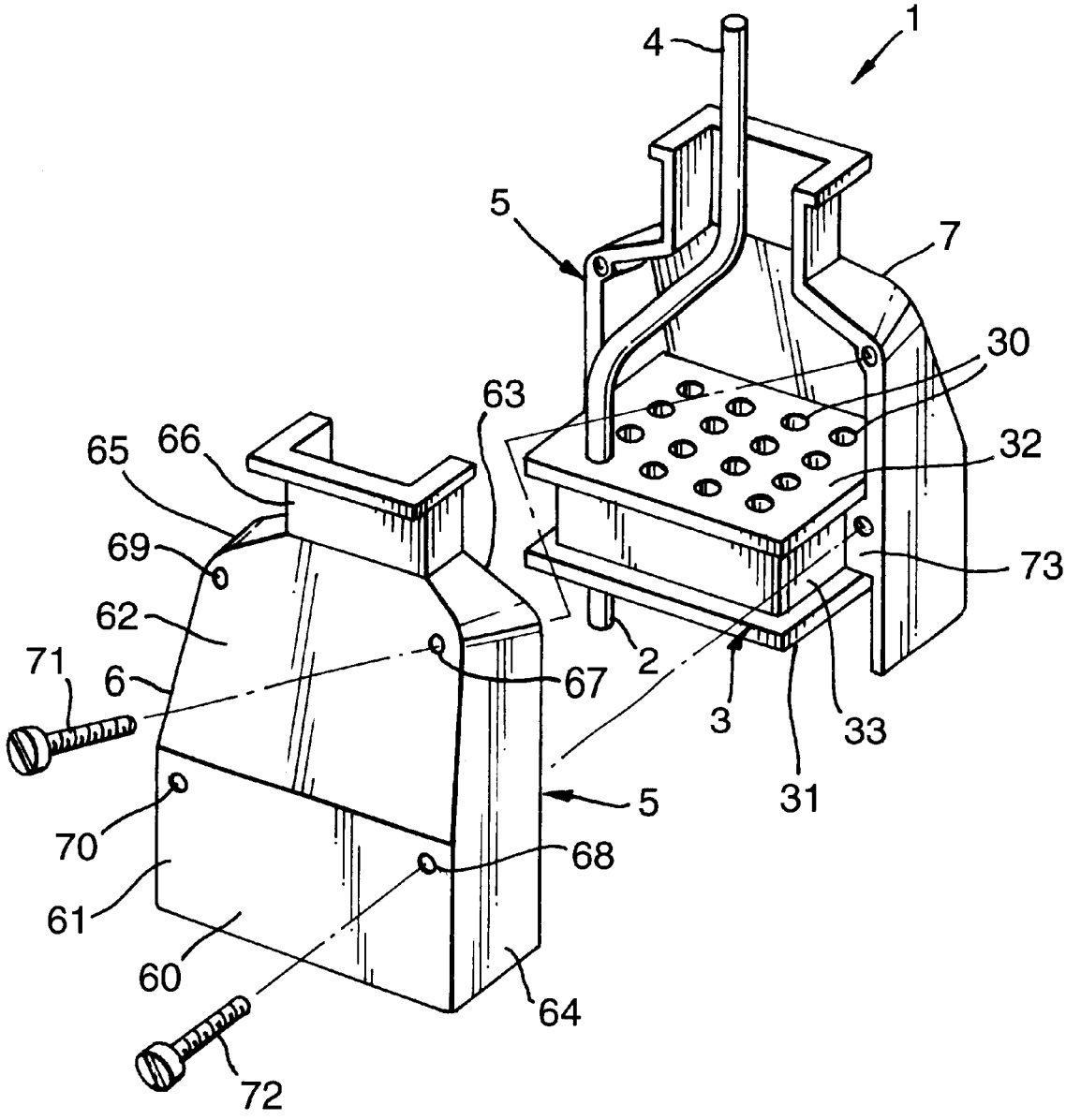
FIG. 1 is a perspective, exploded view of a connector of the system.

With reference first to FIG. 1, there is shown a connector 1 of the system having sixteen coaxial contacts 2 (only one shown) arranged in a four-by-four array. The connector includes a connector block 3 of substantially square shape and made of an electrically-insulative material, such as a plastics. The block 3 has an array of four-by-four holes 30 within which the contacts 2 are supported such that they project from the lower surface 31 of the block 3. On the upper surface 32 of the block 3, the contacts 2 are joined with respective wires 4 (only one shown) extending out of the rear of the connector.

The connector also has an outer housing 5 formed from two parts or shells 6 and 7 of a moulded plastics. The shells 6 and 7 are identical with one another so only one shell 6 will described. The shell 6 has a main wall 60 extending across the width of the shell, with a lower, forward part 61 parallel with the length of the connector and with an upper rear part 62 inclined inwardly. The opposite side 63 of the shell 6 is open. The shell 6 also has two narrow side walls 64 and 65 extending the depth of the shell parallel to the length of the connector. The shell 6 is slightly asymmetrical, one of the side walls 65 having a slightly greater depth than the other wall 64. At its upper, rear end, the shell 6 has a portion of reduced width providing one half of a neck 66 through which the wires 4 enter the connector. Four holes 67 to 70 open on the main wall 60 from passages extending the depth of the shell within the thickness of the side walls 64 and 65. Two holes 67 and 68 receive screws 71 and 72, which are screwed into corresponding threaded holes in the other shell 7. The other two holes 69 and 70 are threaded to receive screws projecting from the other shell 7. Internally, each shell 6 and 7 has a ridge 73 towards its lower end, which locates in a channel 33 around the outside of the connector block 3. With the two shells 6 and 7 screwed together about the connector block 3, the connector is complete. The shells may be provided with polarization features to ensure that the connector can only be mated in the correct orientation with a cooperating connector. The shells may also have some form of latch so that cooperating connectors are retained together until the latch is released.

Figure 2:
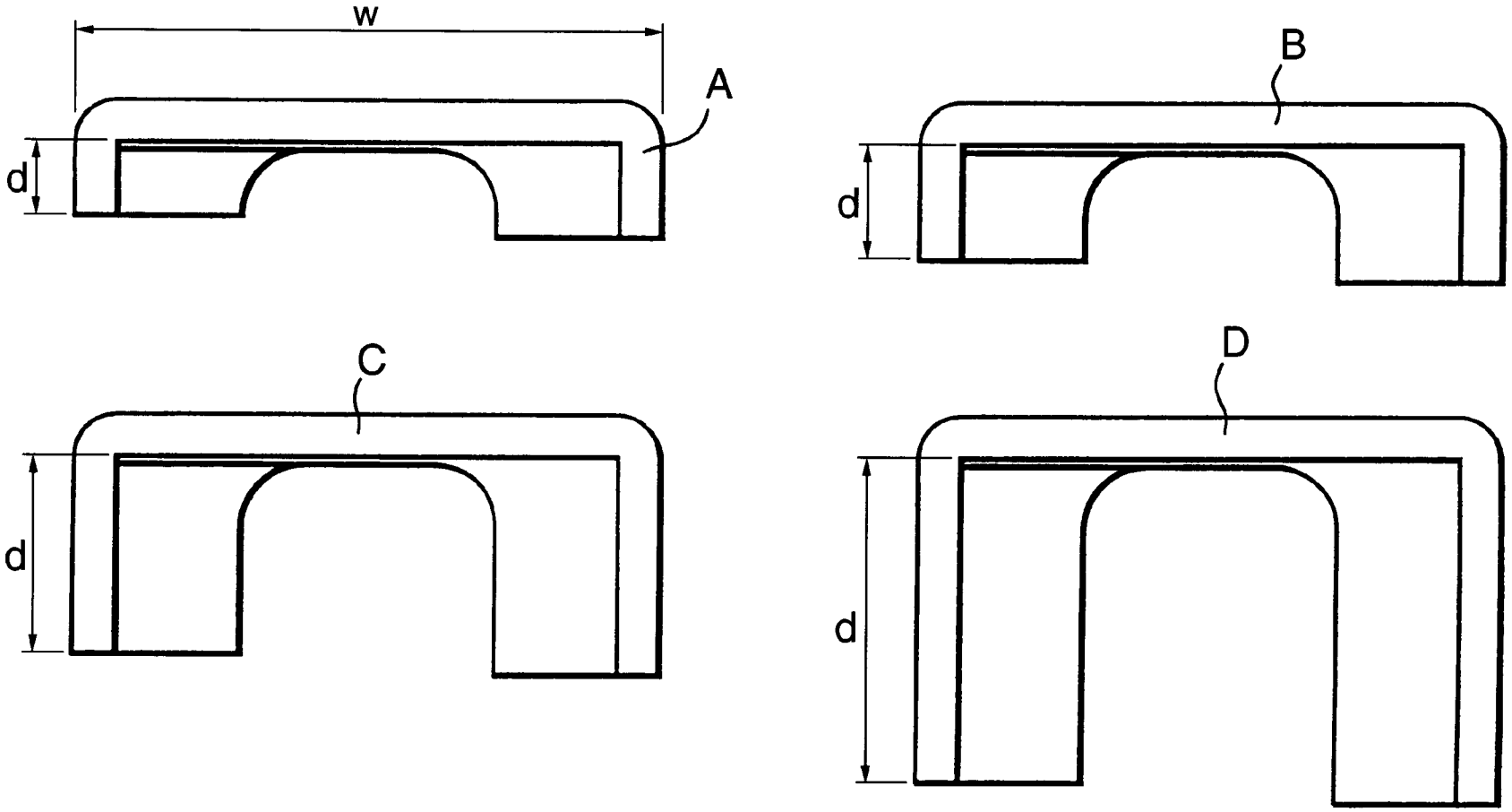
FIG. 2 is a plan view of four different size parts of the housing of connectors of the system.
Figure 3:
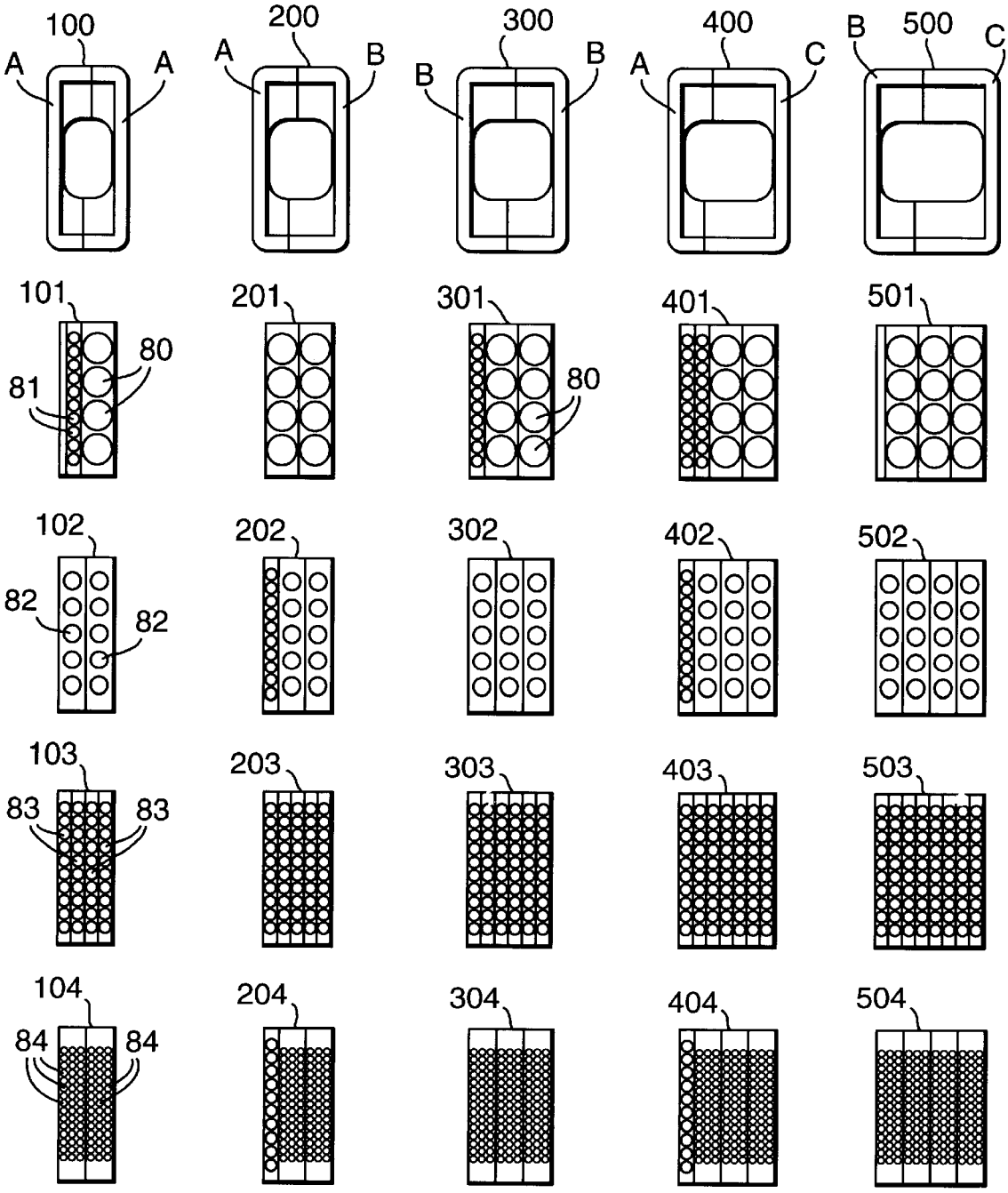
FIG. 3 is a table showing examples of different size and configuration connectors of the system.
Figure 3:
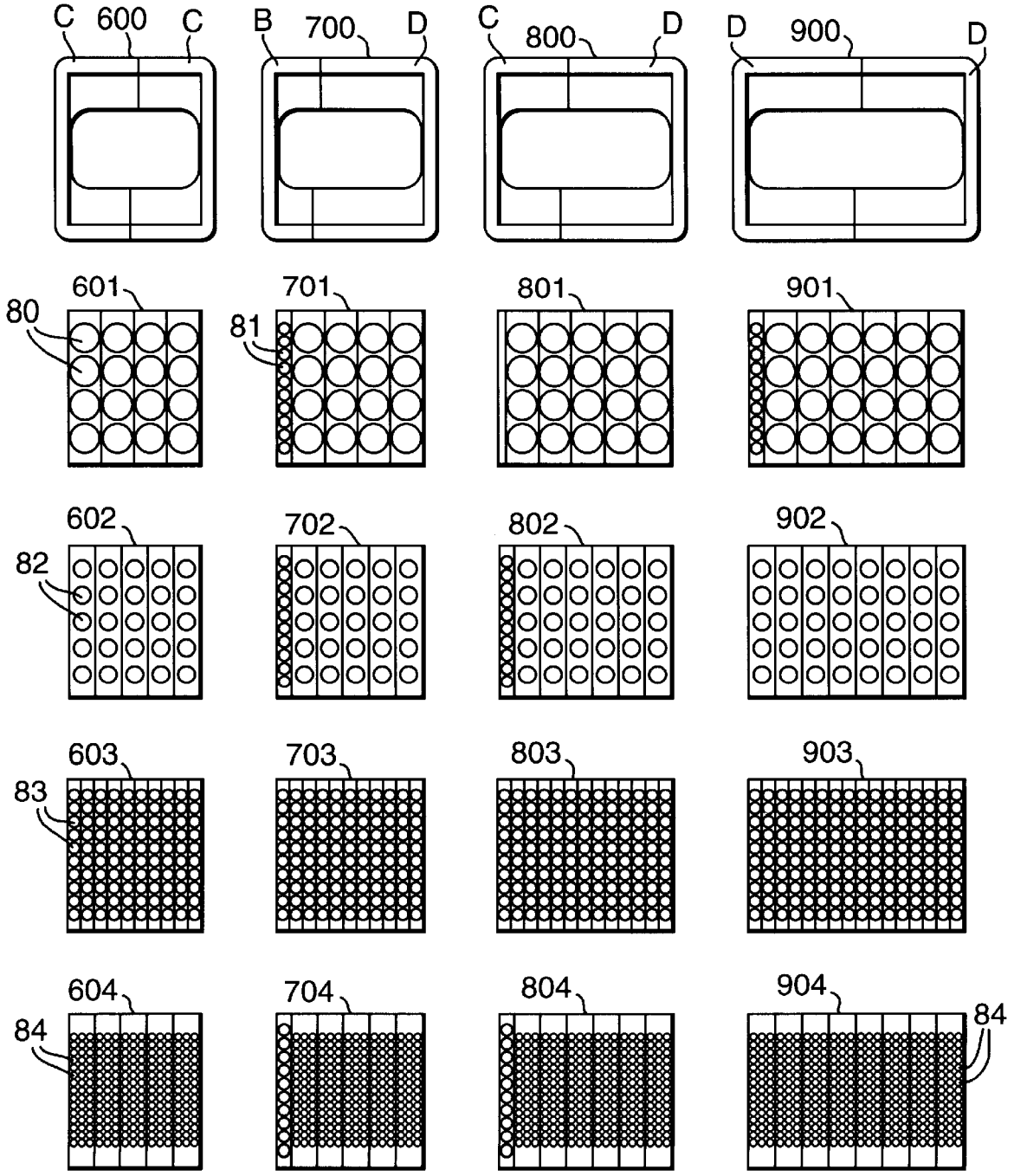

The connector system comprises n connectors, where n is at least three. The connectors have the same width but different depths, to accommodate connector blocks of different depths, and have housings with some common parts. In the present example, the system comprises nine different connector sizes, as shown in FIG. 3, making use of only four different sizes of connector shells A, B, C and D, as shown in FIG. 2. The width "w" of the four shells is identical but the depth varies. The internal depth "d" of the shorter of the two side walls 64 is as follows for the four different sizes: A–4.44 mm, B–6.98 mm, C–12.06 and D–19.69 mm. It can be seen that the increase h in depth of B over A is 2.54 mm, the increase in depth of C over B is 3h and the increase of D over C is 6h. The shells 6 and 7 shown in the connector in FIG. 1 are both of the third largest size C.

With reference to FIG. 3, it can be seen that nine different size connectors can assembled from the appropriate connector block and different combinations of two of the four shells A to C. The table below sets out which shells are used to make the different connectors in order of increasing width:

| Connector | Shells |
|---|---|
| 100 | A and A |
| 200 | A and B |
| 300 | B and B |
| 400 | A and C |
| 500 | B and C |
| 600 | C and C |
| 700 | B and D |
| 800 | C and D |
| 900 | D and D |

The connector 1 described with reference to FIG. 1 is equivalent to the connector 600 in the table, being formed from two of the third-largest shells C.

The smallest of the connectors 100 can be used with any of four different connector blocks 101, 102, 103 or 104, shown in FIG. 3 below the connector. The uppermost block 101 includes four coaxial contacts 80 and ten smaller signal contacts 81. The other blocks 102, 103 and 104 include respectively: ten 1.5 mm contacts 82, forty 0.6 mm contacts 83 and ninety 0.4 mm contacts 84.

The next largest of the connectors 200 can be used with any of the four different connector blocks 201 to 204 as shown, which include different combinations of the contacts 80 to 84.

Similarly, the other connectors 300, 400, 500, 600, 700, 800 and 900 can each be used with different blocks 301 to 304, 401 to 404, 501 to 504, 601 to 604, 701 to 704, 801 to 804 and 901 to 904. These each comprise different numbers and combinations of the contacts, up to three hundred and sixty of the smallest 0.4 mm contacts 84 in the case of the block 904.

The present invention is applicable to systems of at least three different-size connectors, which could be provided by just two different size housing parts. The smallest connector would be formed from the two smaller housing parts, the intermediate size would be formed from one of the smaller and one of the larger housing parts, and the largest size connector would be formed from the two larger housing parts.

The system of the present invention enables different size connectors to be manufactured using fewer component parts. This reduces manufacturing costs by saving on tooling and also enables fewer different parts to be stocked, reducing inventory costs.

It will be appreciated that the connectors could have various different sizes and shapes and that the invention could be applied to connector backshells as well as to the main part of a connector housing.

What I claim is:

1. A connector system comprising at least three connectors, each said connector having a common width and a different depth, wherein each said connector includes a two-part housing formed from selected ones of two different parts, and wherein the said two different parts have a common width and two different depths, namely a first depth and a second depth larger than said first depth such that a connector of the smallest depth can be formed from two of said housing parts of said first depth, a connector of an intermediate depth can be formed from one of said housing parts of said first depth and another of said housing parts of said second depth, and a connector of the largest depth can be formed from two of said housing parts of said second depth.

2. A connector system comprising: n different connectors formed of n connector blocks and 2n housing parts where n is at least three, wherein said connector blocks each have a common width and a depth that differs from block to block, wherein said connector housing parts each have a common width and some have a different depth from one another, wherein each said connector includes one said connector block and two said housing parts, and wherein at least one said connector has two said housing parts of different depths and at least two said connectors have two said housing parts of identical depth.

3. A connector system according to claim 2, wherein n is nine.

4. A connector system according to claim 3, including eighteen said housing parts having four different depths.

5. A connector system according to claim 4, wherein the depth of the said housing parts of different depths increases in steps of h, 3h and 6h over the depth of the smallest of said housing parts.

6. A method of forming two connectors of different sizes from n connector blocks and 2n housing parts, where n is at least three, the connector blocks each having a common width and a depth that differs from block to block, the connector housing parts each having a common width and some having a different depth from one another, comprising the steps of: selecting a first connector block and two housing parts; joining said block and said two housing parts to form a first connector; selecting a second connector block of a different depth from said first block and two housing parts at least one of which has a different depth from said housing parts of said first connector; and joining said block and housing parts to form the second connector having a depth different from that of said first connector.

* * * * *